US012108825B2

(12) United States Patent
Robinson et al.

(10) Patent No.: US 12,108,825 B2
(45) Date of Patent: Oct. 8, 2024

(54) IMPACT PROTECTION SYSTEM

(71) Applicant: ANTI ORDINARY PTY LTD, Ormeau (AU)

(72) Inventors: Brodie William Robinson, Daisy Hill (AU); Robert William Joseph, Ormeau (AU)

(73) Assignee: ANTI ORDINARY PTY LTD, Ormeau (AU)

( * ) Notice: Subject to any disclaimer, the term of this patent is extended or adjusted under 35 U.S.C. 154(b) by 189 days.

(21) Appl. No.: 16/761,050

(22) PCT Filed: Oct. 30, 2018

(86) PCT No.: PCT/AU2018/051167

§ 371 (c)(1),
(2) Date: Oct. 28, 2020

(87) PCT Pub. No.: WO2019/084603

PCT Pub. Date: May 9, 2019

(65) Prior Publication Data

US 2021/0315306 A1 Oct. 14, 2021

(30) Foreign Application Priority Data

Nov. 1, 2017 (AU) ..... 2017904446

(51) Int. Cl.
*A42B 3/06* (2006.01)
*A42B 3/12* (2006.01)

(52) U.S. Cl.
CPC ..... *A42B 3/063* (2013.01); *A42B 3/067* (2013.01); *A42B 3/124* (2013.01)

(58) Field of Classification Search
CPC ..... A42B 3/063; A42B 3/067; A42B 3/124
See application file for complete search history.

(56) References Cited

U.S. PATENT DOCUMENTS 3,579,637 A 5/1971 Aileo
4,827,537 A 5/1989 Villa
6,065,158 A * 5/2000 Rush, III ..... A42B 3/0433 2/412

(Continued)

FOREIGN PATENT DOCUMENTS

CA 2969799 A1 12/2018
GB 2497345 A 6/2013

(Continued)

OTHER PUBLICATIONS

Chinese Office Action issued on Mar. 24, 2021, in the prosecution of Chinese patent application No. 201880085152.2, 6 pages.

(Continued)

*Primary Examiner* — Heather Mangine
*Assistant Examiner* — Erick I Lopez
(74) *Attorney, Agent, or Firm* — Bracewell LLP; Constance G. Rhebergen; Keith R. Derrington

(57) ABSTRACT

A wearable impact protection system is provided that includes an inner layer of a first shear thickening material that faces a wearer in use, an outer layer of a second shear thickening material and an intermediate deformable layer. In one example the impact protection system is provided in the form of a helmet.

17 Claims, 20 Drawing Sheets

(56) References Cited

U.S. PATENT DOCUMENTS

| | | | | |
|---|---|---|---|---|
| 6,256,799 | B1 | 7/2001 | McGlasson | |
| 6,751,808 | B2 | 6/2004 | Puchalski | |
| 6,848,122 | B1 | 2/2005 | Meeds | |
| 8,955,169 | B2 | 2/2015 | Weber et al. | |
| 2007/0157370 | A1* | 7/2007 | Joubert Des Ouches | A42B 3/06 2/410 |
| 2008/0060112 | A1 | 3/2008 | Driehorst | |
| 2009/0064385 | A1 | 3/2009 | Crossman et al. | |
| 2009/0191989 | A1* | 7/2009 | Lammer | A42B 3/063 473/549 |
| 2011/0271426 | A1 | 11/2011 | Roesler | |
| 2014/0259326 | A1* | 9/2014 | Carlson | A42B 3/121 2/455 |
| 2015/0033453 | A1 | 2/2015 | Pannikottu et al. | |
| 2015/0164174 | A1* | 6/2015 | West | A42B 3/069 2/414 |
| 2015/0216249 | A1 | 8/2015 | Leon | |
| 2015/0223545 | A1* | 8/2015 | Fraser | A42B 3/121 2/413 |
| 2015/0320134 | A1 | 11/2015 | Stolker | |
| 2016/0021947 | A1 | 1/2016 | Dor-El et al. | |
| 2016/0271482 | A1* | 9/2016 | Garland | A42B 3/128 |

FOREIGN PATENT DOCUMENTS

| | | | |
|---|---|---|---|
| WO | 1998006285 | | 2/1998 |
| WO | 2017192885 | A3 | 2/1998 |
| WO | 2004040227 | A1 | 5/2004 |
| WO | 2012106446 | A2 | 8/2012 |
| WO | 2016028415 | A1 | 2/2016 |
| WO | 2016149307 | | 2/2016 |
| WO | 2016149523 | A2 | 9/2016 |
| WO | 2019076689 | A1 | 4/2019 |
| WO | 2019084603 | A1 | 5/2019 |

OTHER PUBLICATIONS

PCT International Preliminary Report on Patentability mailed on May 14, 2020, issued for PCT/AU2018/051167, filed Oct. 30, 2018, 8 pages.

Extended European Search Report mailed on July 2, 202, in the prosecution of European Application No. 18873973.4, PCT/AU2018051167, 7 pages.

PCT ISRWO issued for PCT/AU2021/050653 on Aug. 21, 2021, 5 pages.

PCT International Search Report; PCT/AU2018/051167; Date of Mailing Jan. 25, 2019.

Search Information Statement (SIS), PCT/AU2018/051167, Date of Report Jan. 25, 2019.

Canadian Office Action issued on Dec. 6, 2023, in the prosecution of Canadian patent application No. 3,118,362, 4 pages.

Japanese Decision of Rejection issued on Aug. 22, 2023, in the prosecution of Japanese patent application No. 2020-544066, 4 pages.

* cited by examiner

IMPACT PROTECTION SYSTEM

BACKGROUND OF THE INVENTION

The present invention relates broadly to an impact protection system and in one example to a wearable impact protection system, such as a helmet.

DESCRIPTION OF THE PRIOR ART

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

It is known to provide impact protection systems, such as helmets. Traditional helmets include a rigid outer shell overlaying a deformable material. When struck by an object, the other rigid shell tends to dissipate forces, and prevent penetration by the object, whilst the deformable material acts to absorb the forces. Whilst such systems can provide a high degree of protection, they tend to be heavy, unwieldly and difficult to transport, as well as being uncomfortable to wear for physical activities, such as cycling, skiing, snowboarding or the like.

A number of attempts have been made to address such deficiencies. For example, U.S. Pat. No. 8,955,169 describes an embodiment of a safety helmet for protecting the human head against repetitive impacts, moderate impacts and severe impacts so as to significantly reduce the likelihood of both translational and rotational brain injury and concussions includes an outer shell, an outer liner disposed within and coupled to the outer shell, and an inner liner disposed within and coupled in spaced opposition to the outer liner by a plurality of isolation dampers for omnidirectional movement of the inner liner relative to the outer liner and the outer shell. Whilst this results in a lighter construction than traditional arrangements, this is also complex to manufacture and hence expensive.

US20150320134 describes a lightweight protective headgear for non-contact sports comprising a soft foam helmet designed to prevent head and facial injuries to the user. Whilst this is lightweight and flexible, this provides minimal protection and is therefore not suitable for many applications.

It is also known to provide impact protection systems for protecting other parts of the body, for example by incorporating foam padding into pockets of a suitable constructed jacket. For example, US20080060112 describes a motorcycle jacket including a jacket shell having a rear panel and a split front panel, the shell defining arm openings and being adapted for covering the shoulders and torso. A pair of sleeves extend from the arm openings. The split front panel includes a releasable fastener, such as a zipper, for closing the front panel. At least the sleeves have a lining formed of an abrasion resistant fabric. The elbows have pockets inside the sleeves that removably receive protective foam pads, and a protective foam pad for the spine is removably disposed adjacent the rear panel on the inside of the jacket shell. The spine pad is attached to a flexible panel of abrasion resistant fabric, either directly or by being placed in a pocket or pouch formed on the panel, the panel being secured to the shell by releasable fasteners.

Attempts have been made to further improve such arrangements using shear thickening materials. For example, US20160021947 describes a hoodie including a hood and a pair of sleeves, a head protective element and elbow, shoulder, wrist, back and torso protective pads. The head protective element is coupled to the hood of the hoodie by a fastening system. Each of the elbow protective pads is coupled to the hoodie by a fastening system. Protective elements are spacer fabrics filled with a shear thickening (also known as dilatant) gel having flexibility and drapeability so as not to degrade the natural "cool" look of a standard garment.

SUMMARY OF THE PRESENT INVENTION

In one broad form and aspect of the present invention seeks to provide a wearable impact protection system including: an inner layer of a first shear thickening material that faces a wearer in use; an outer layer of a second shear thickening material; and, an intermediate deformable layer.

In one embodiment the inner layer is thicker than the outer layer.

In one embodiment: the inner layer has a thickness that is at least one of: ~1 mm; >3 mm; <10 mm; <12 mm; 3-10 mm; 4-8 mm; 5-7 mm; ~5 mm; and, ~6 mm; and, the outer layer has a thickness that is at least one of: ~1 mm; >1 mm; <8 mm; <10 mm; <12 mm; 1-5 mm; 2-4 mm; ~5 mm; and, ~3 mm.

In one embodiment the inner layer has a lower density than the outer layer.

In one embodiment at least one of: the inner layer has a density that is at least one of: >80 kg/m$^3$; <400 kg/m$^3$; <200 kg/m$^3$; 100-400 kg/m$^3$; 100-200 kg/m$^3$; 120-180 kg/m$^3$; 140-160 kg/m$^3$; >500 kg/m$^3$; >1000 kg/m$^3$; <1400 kg/m$^3$; <1200 kg/m$^3$; and, 1100-1140 kg/m$^3$; and, the outer layer has a density that is at least one of: >80 kg/m$^3$; <400 kg/m$^3$; 150-400 kg/m$^3$; 180-340 kg/m$^3$; 200-300 kg/m$^3$; >500 kg/m$^3$; >1000 kg/m$^3$; <1400 kg/m$^3$; <1200 kg/m$^3$; and, 1100-1140 kg/m$^3$.

In one embodiment at least one of the inner and outer layers are made of at least one of: a shear thickening foam; a shear thickening moulded foam; a polymer matrix including a shear thickening additive; and, a polyurethane energy-absorbing material containing Polyborodimethylsiloxane.

In one embodiment the intermediate layer has a thickness that is at least one of: >5 mm; <20 mm; 5-20 mm; 8-17 mm; 10-15 mm; 8-12 mm; and ~10 mm.

In one embodiment the intermediate layer is made of at least one of: an auxetic material; a deformable fluid layer; an impact absorbing foam; an elastically deformable layer; a plastically deformable layer; a plastic; a rubber; a shear thickening material; kevlar; an EPU (Expanded PolyUrethane) foam; an EPS (Expanded Polystyrene) foam; and, a PPS (Polyphenylene Sulfide) foam.

In one embodiment the intermediate layer has a density that is at least one of: >100 kg/m$^3$; >200 kg/m$^3$; <1000 kg/m$^3$; <800 kg/m$^3$; and, 300-500 kg/m$^3$.

In one embodiment at least one of the inner and outer layers includes at least one of: at least one sheet; at least one moulded sheet; a plurality of sheets; and, one or more at least partially overlapping sheets.

In one embodiment at least one of the inner, outer and intermediate layers includes at least one of: a honeycomb structure; one or more holes that allow airflow therethrough; surface features that enhance localised flexibility; surface features that at least partially engage with the intermediate layer; variable thickness; and, ribbing.

In one embodiment the inner and outer layers are at least partially coupled along one or more edges.

In one embodiment the intermediate layer is at least partially coupled to at least one of the inner and outer layers.

In one embodiment the intermediate layer is coupled to both the inner and outer layers to allow constrained relative movement of the inner and outer layers.

In one embodiment layers are at least partially coupled using at least one of: mechanical bonding; chemical bonding; welding; adhesive; and, fasteners.

In one embodiment the impact protection system includes a plurality of cells, at least some of the cells including: an inner layer of a first shear thickening material that faces a wearer in use; an outer layer of a second shear thickening material; and, an intermediate deformable layer.

In one embodiment the plurality of cells are provided in a tessellated arrangement.

In one embodiment the plurality of cells include at least first and second cell shapes.

In one embodiment adjacent cells are shaped to at least partially overlap.

In one embodiment adjacent cells have complementarily sloped side walls.

In one embodiment the side walls are sloped at an angle that is at least one of: >5°; >10°; >15°; >20°; <45°; <40°; <35°; <30°; and, ~27°.

In one embodiment the plurality of cells are mounted on a substrate layer.

In one embodiment the plurality of cells are removably mounted to the substrate layer.

In one embodiment the substrate layer is made of at least one of: an elasticated fabric; a woven fabric; and, a non-woven fabric.

In one embodiment the substrate layer is coupled to a securing mechanism to secure the impact protection system to a user.

In one embodiment the system includes an internal frame that provides rigidity.

In one embodiment the internal frame is at least one of: within the intermediate layer; and, between the intermediate layer and at least one of the inner and outer layers.

In one embodiment the frame is made of at least one of: metal; plastic; and, HDPE (High-density polyethylene).

In one embodiment the impact protection system includes a penetration resistant layer.

In one embodiment the penetration resistant layer is made of at least one of: a thermoplastic polymer; ABS (Acrylonitrile Butadiene Styrene); kevlar; and, HDPE (High-density polyethylene).

In one embodiment the impact protection system includes a visual indicator indicative of a damage state of the impact protection system.

In one embodiment the visual indicator undergoes a colour change following an impact with the impact protection system.

In one embodiment the impact protection system is a helmet.

In one embodiment at least one of the inner and outer layers are moulded foams shaped to at least partially conform to the head of a wearer.

In one embodiment at least one of the inner and outer layers has an approximately hemispherical shape with one or more radial slits having overlapping edges.

In one embodiment the inner and outer layers each include one or more radial slits with overlapping edges, and wherein slits in the inner and outer layers are offset.

In one embodiment at least one of the inner and outer layers is made of a plurality of triangular sheets with overlapping edges.

In one embodiment the helmet includes an adjustment mechanism to at least partially adjust the size of the helmet.

In one embodiment the adjustment mechanism includes: one or more tensioning members; an elasticated tensioning system; a ratchet tensioning system; and, an adjustable internal frame.

In one embodiment the adjustment mechanism adjusts a degree of overlap between edges in the inner and outer layers.

In one embodiment the one or more tensioning members are at least one of: within the intermediate layer; and, between the intermediate layer and at least one of the inner and outer layers.

In one embodiment the helmet includes one or more chinstraps to secure the helmet to a wearer.

In one embodiment the chinstraps are attached to at least one of: the inner layer; the outer layer; an internal frame; an adjustment mechanism; and, one or more tensioning members.

In one embodiment the helmet includes an inner and outer skin, the inner, outer and intermediate layers being provided between the inner and outer skin.

In one embodiment at least one of the inner and outer skin are made of at least one of: a woven fabric; a non-woven fabric; and, an elasticated fabric.

It will be appreciated that the broad forms of the invention and their respective features can be used in conjunction, interchangeably and/or independently, and reference to separate broad forms is not intended to be limiting.

BRIEF DESCRIPTION OF THE DRAWINGS

Various examples and embodiments of the present invention will now be described with reference to the accompanying drawings, in which: —

DETAILED DESCRIPTION OF THE PREFERRED EMBODIMENTS

Figure 1:
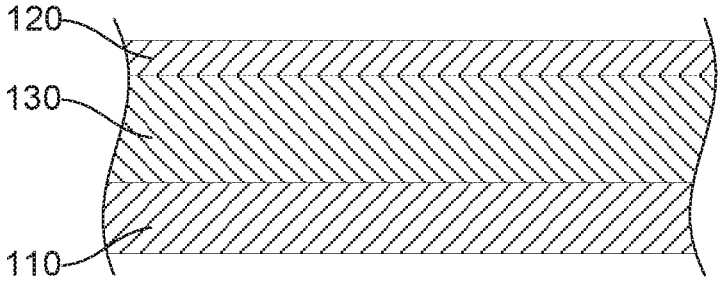
FIG. 1 is a schematic cross sectional side view of an example of a wearable impact protection system.

An example of a wearable impact protection system will now be described with reference to FIG. 1.

In this example, the impact protection system includes a first inner layer 110 of a first shear thickening material that faces a wearer in use, a second outer layer 120 of a second shear thickening material, and an intermediate deformable layer 130.

In use, the wearable impact protection system operates to provide a wearer with protection against impact. In particular, upon impact by an object the outer shear thickening material layer 120 will harden causing the impacting force to be distributed over a wider surface area than that of the contact area of the incident object. The deformable layer 130 will operate to deform, either plastically or elastically, in order to absorb energy from the impact. Finally, the inner layer of shear thickening material 110 will operate to harden and further distribute any remaining force, such that remaining force is distributed over a wide area of the wearer, thereby reducing the overall impact of the force.

Through appropriate selection of shear thickening materials and the intermediate deformable layer, the wearable impact protection system can have a high degree of flexibility, whilst maintaining a high degree of impact protection. This allows such arrangements to be incorporated into a wide range of wearable articles without adversely affecting flexibility or usability by the wearer. Specific examples include flexible helmets, padding in protective clothing, such as jackets and pants for motorbike riders, sports clothing, such as football jerseys or helmets, medical devices, or the like, although it will be appreciated that this list is not intended to be exhaustive.

A number of further features will now be described.

In the above example, each layer is shown extending across the entire body of the impact protection system. However, this is not essential and alternative arrangements could be used in which one or more of the layers extend partially across the protection system. For example, the intermediate layer could be a discrete layer formed internally within the first and second layers. Additionally and/or alternatively, the impact protection system can include a number of individual cells, each of which includes respective layers, with cells cooperating to provide an overall impact protection system, as will be described in more detail below.

In one example, the inner layer 110 is thicker than the outer layer 120. This particular arrangement is used to maintain a high degree of flexibility, whilst ensuring residual forces transmitted through the deformable layer are readily distributed over a wide area reducing the overall impact on the wearer. To further facilitate this, the inner layer typically has a lower density than the outer layer, such that the outer layer provides an initial high degree of protection, whilst the inner layer provides a higher degree of absorption of the transmitted force. However, this is not essential and the inner and outer layers could be made of the same thickness and have the same density, which is particularly useful in the event that a thick lightweight configuration is required, for example when there is only a need to protect against minor impacts.

In one example, the inner layer has a thickness that is greater than 3 mm, less than 10 mm, less than 12 mm, in between 3 mm and 10 mm, between 4 mm and 8 mm, or between 5 mm and 7 mm, and more typically approximately 5 mm or 6 mm. However, when a thinner lightweight arrangement is to be provided the inner layer could have a thickness of approximately 1 mm. The outer layer 120 typically has a thickness that is greater than 1 mm, less than 8 mm, less than 12 mm, less than 10 mm, between 1 mm and 5 mm, or between 2 mm and 4 mm, and more typically approximately 5 mm or 3 mm, although again an approximately 1 mm thick layer could be used for a lightweight arrangement.

The inner layer typically has a density that is greater than 80 kg/m$^3$, less than 400 kg/m$^3$, less than 200 kg/m$^3$, between 100 kg/m$^3$ and 400 kg/m$^3$, between 100 kg/m$^3$ and 200 kg/m$^3$, or between 120 kg/m$^3$ and 180 kg/m$^3$, and more typically between and 140 kg/m$^3$ and 160 kg/m$^3$, whilst the outer layer typically has a density that is greater than 80 kg/m$^3$, less than 400 kg/m$^3$, between 150 kg/m$^3$ and 400 kg/m$^3$, or between 180 kg/m$^3$ and 340 kg/m$^3$, and more typically between 200 kg/m$^3$ and 300 kg/m$^3$. However, this is not essential and other layer thicknesses and densities could be used, for example, depending on the intended application. In another example, both the inner and outer layers have a density that more than 500 kg/m$^3$, more than 1000 kg/m$^3$, less than 1400 kg/m$^3$, less than 1200 kg/m$^3$, and more typically between 1100 kg/m$^3$ to 1140 kg/m$^3$.

Typically the inner and outer layers are made of a shear thickening foam, such as a shear thickening moulded foam. Use of a moulded foam advantageously allows the impact protection system to be pre-moulded into a shape that at least partially conforms with a part of the body the impact protection system is configured to protect, making the impact protection system more comfortable to use. However, it will be appreciated that this is not essential, and other configurations, such as providing a flat laminar shape, could be used. In another example, the flexibility of the impact protection system could be used so that the protection system is urged into place, thereby conforming to the shape of the body in use.

A range of different shear thickening foams could be used, but in one example the foam includes a polymer matrix including a shear thickening additive and in one particular example includes a polyurethane energy absorbing material containing polyborodimethylsiloxane. In one preferred example the inner and outer layers are mode of is PORON XRD™. Again however, it will be appreciated that different materials could be selected depending on the intended application.

The intermediate layer typically has a thickness of at least 5 mm, less than 20 mm, between 5 mm and 20 mm, or between 8 mm and 17 mm, and more typically between 10 mm and 15 mm, between 8 mm and 12 mm and typically approximately 10 mm. The intermediate layer can have a density that is less than 100 kg/m$^3$, less than 200 kg/m$^3$, less than 1000 kg/m$^3$, less than 800 kg/m$^3$ or between 300 kg/m$^3$ and 500 kg/m$^3$.

In one example, the inner and outer layers have a thickness and density selected to obtain a desired degree of protection, whilst properties of the intermediate layer are selected to maintain an overall desired weight for the impact protection system.

Typically the intermediate layer is made of one or more of an auxetic material, such as an auxetic foam, a deformable fluid layer, such as air or gel pockets or similar, an impact absorbing foam, an elastically deformable layer, a plastically deformable layer, a plastic, a rubber, a shear thickening material, Kevlar, an EPU (expanded polyurethane) foam, an EPS (expanded polystyrene) foam and a PPS (polyphenylene sulfide) foam. The intermediate layer could also be made of multiple materials, for example including multiple intermediate layers, and could include a varying density, for example increasing in density from the inner to the outer layer, or vice versa. However, this is not essential and other materials, layer thickness and configurations could be used, for example, depending on the intended application.

As mentioned above, the exact nature of the materials used, and the densities and thicknesses of the respective layers may vary depending upon the preferred implementation. It has been found however that the above described arrangements tend to provide a sufficient degree of impact protection for the majority of scenarios, and in particular needed to meet legislative certification requirements for sporting or general recreational activity, whilst also maintaining a sufficient degree of flexibility to make the impact protection system comfortable to use.

Figure 2:
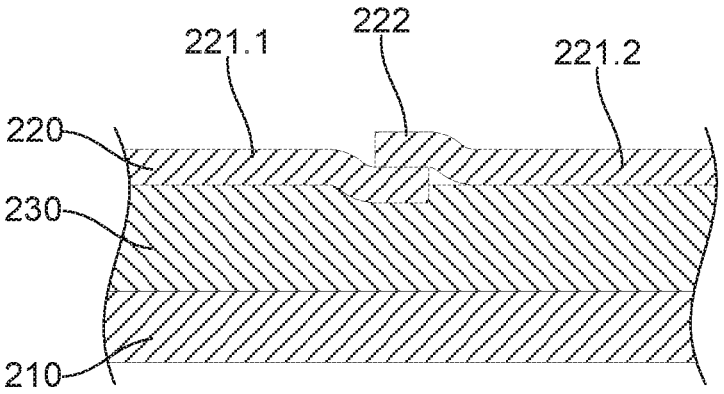
FIG. 2 is a schematic cross sectional side view of an example of a wearable impact protection system incorporating overlapping sheets.

The inner and outer layers typically include foam sheets, and may include a single sheet, a single moulded sheet, or a plurality of sheets. In one example, where edges of one or more sheets meet, these are provided in an at least partially overlapping manner, an example of which is shown in FIG. 2.

In this example, the impact protection system again includes inner and outer layers 210, 220 and an intermediate layer 230. The outer layer 220 includes two separate sheets 221.1, 221.2 which overlap to provide an overlapping join 222. The use of the overlap ensures that protection is provided even in the event of an impact at the overlapping join 222. The use of an overlapping join is particularly beneficial in allowing multiple sheets to be used, which in turn enables a greater range of sheet configurations to be provided. Additionally, this can provide a greater degree of flexibility, for example allowing the sheets 221.1, 221.2 to move relative to each other, whilst maintaining a continuous outer layer as will be described in more detail below.

The intermediate layer can also include a sheet material, but may additionally or alternatively include discrete elements, such as a plurality of beads, discrete foam sections, or the like, which are held in place by the inner and outer layers.

Figure 3A:
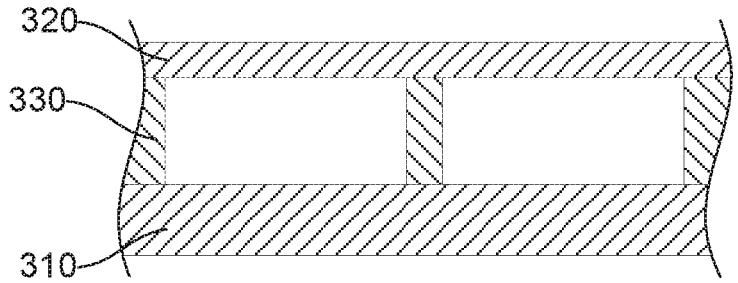
FIG. 3A is a schematic cross sectional side view of an example of a wearable impact protection system incorporating a honeycomb structure.
Figure 3B:
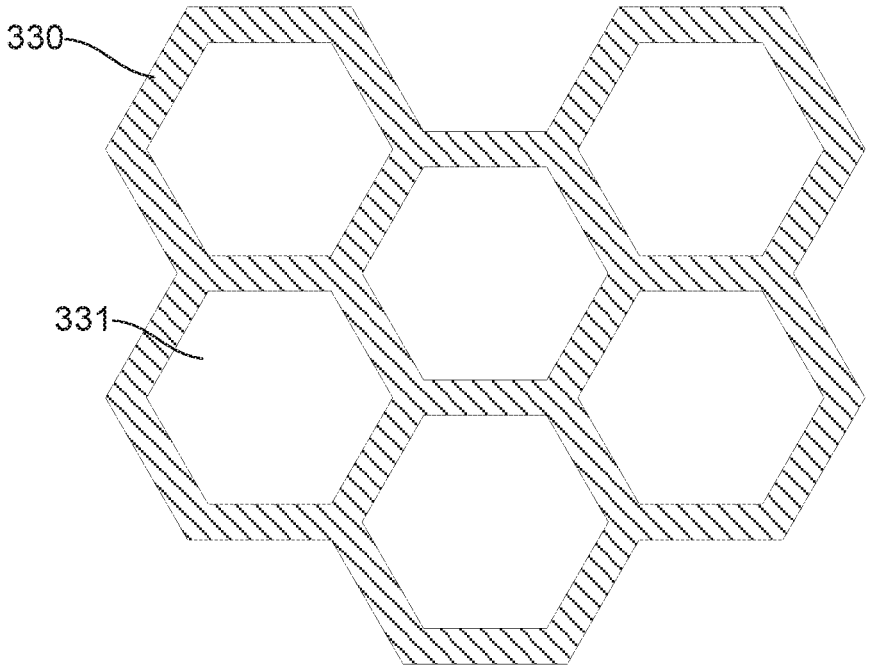
FIG. 3B is a schematic plan view of the honeycomb structure of FIG. 3A.

Additionally, whilst the layers can be solid layers, this is not essential and different arrangements can be used. For example, the layers could include a honeycomb structure and an example of this is shown in FIGS. 3A and 3B. In this example the impact protection system again includes inner and outer layers 310, 320 and a honeycombed intermediate layer 330, which defines a number of air pockets 331. The use of air pockets can be beneficial for a number of reasons. For example, this can reduce the overall weight, allow for greater flexibility, enhance thermal insulation properties, and reduce material usage and hence cost. Whilst the honeycomb structure is shown in the intermediate layer in this example, this is not essential and it will be appreciated that similar arrangements could be incorporated into the inner and outer layers.

Figure 4:
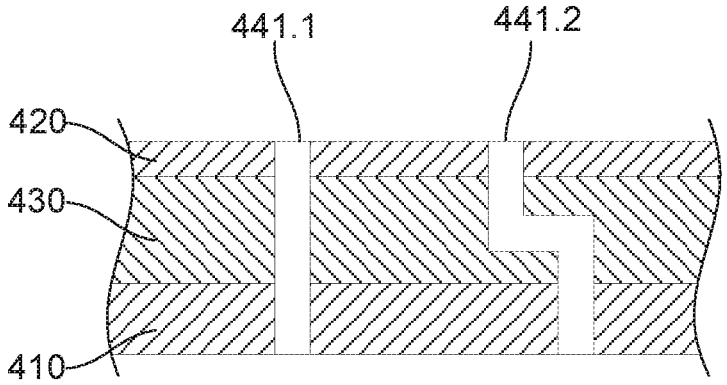
FIG. 4 is a schematic cross sectional side view of an example of a wearable impact protection system incorporating ventilation.

In the example of FIG. 4, a further example of an impact protection system is shown in which the impact protection system includes inner and outer layers 410, 420 and an intermediate layer 430. In this example, openings 441 are provided to allow air flow through the impact protection system, for example to allow for ventilation. As shown by the air holes 441.1, the air holes could pass in a straight line through each of the layers but this is not essential and as shown by the air hole 441.2, an offset or tortuosity could be introduced in order to reduce the likelihood of an incident object passing directly through the impact protection system. In either case, the holes will typically be smaller than a certain defined size, such as 0.5 mm across, to avoid penetration of sharp objects through the protection system and into the wearer. Ventilation could also be provided using other techniques, such as channels passing along an inner surface of the inner layer, using porosity in the materials, or the like.

Figure 5:
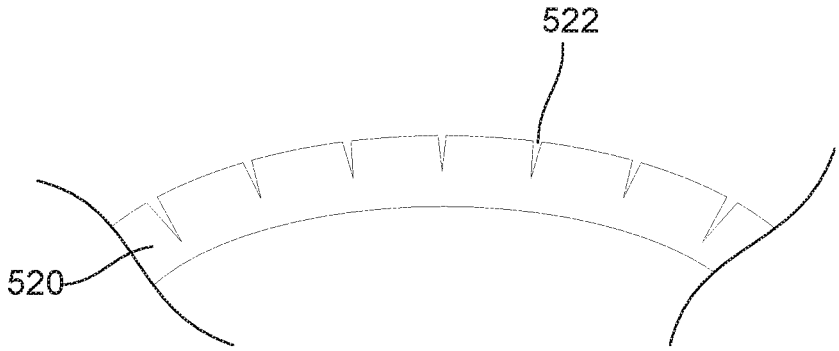
FIG. 5 is a schematic side view of an example of a wearable impact protection system layer incorporating surface features.

The individual layers could also include other features to adapt the properties of the impact protection system. For example, the outer layer 520 shown in FIG. 5 includes surface features, in the form of slits 522, that enhance localised flexibility. In particular, the slits can open as the layer flexes, thereby increasing flexibility of the impact protection system.

Figure 6A:
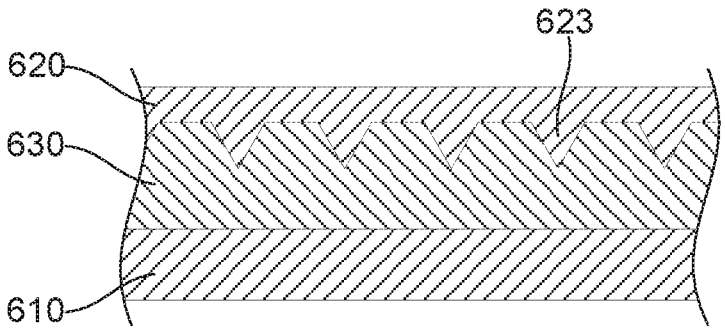
FIGS. 6A and 6B are schematic cross sectional side views of an example of a wearable impact protection system incorporating layer engagement features.
Figure 6B:
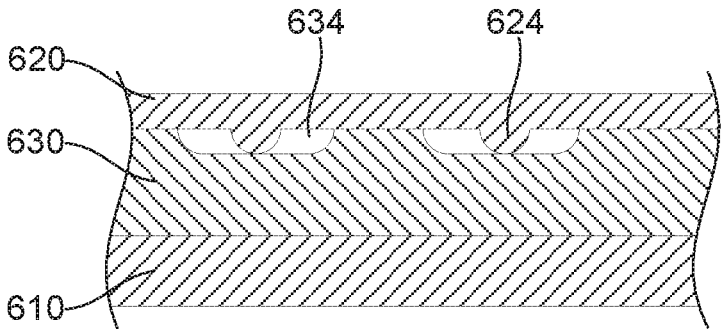

As shown in the examples of FIGS. 6A and 6B, the layers can also include surface features so that different layers partially engage. In these examples, the impact protection system again includes inner and outer layers 610, 620 and an intermediate layer 630. In the example of FIG. 6A, an inner surface of the outer layer 620 includes teeth 623, which engage with the intermediate layer 630, to prevent relative movement of the outer and intermediate layers 620, 630. In contrast, in the example of FIG. 6B, the outer layer 620 includes ribs 624 on an inner surface, which sit within recesses 634 in an outer surface of the intermediate layer 630. This allows constrained relative movement of the outer and intermediate layer 620, 630, which can assist with absorbing angled impacts. It will be appreciated that similar arrangements could be provided between the inner and intermediate layers 610, 630.

It will also be appreciated that other features could be incorporated into the arrangement, such as to have variable thickness layers which can assist in distributing the forces throughout the impact protection system, utilising a ribbing for additional and/or directional rigidity, or the like.

Figure 7:
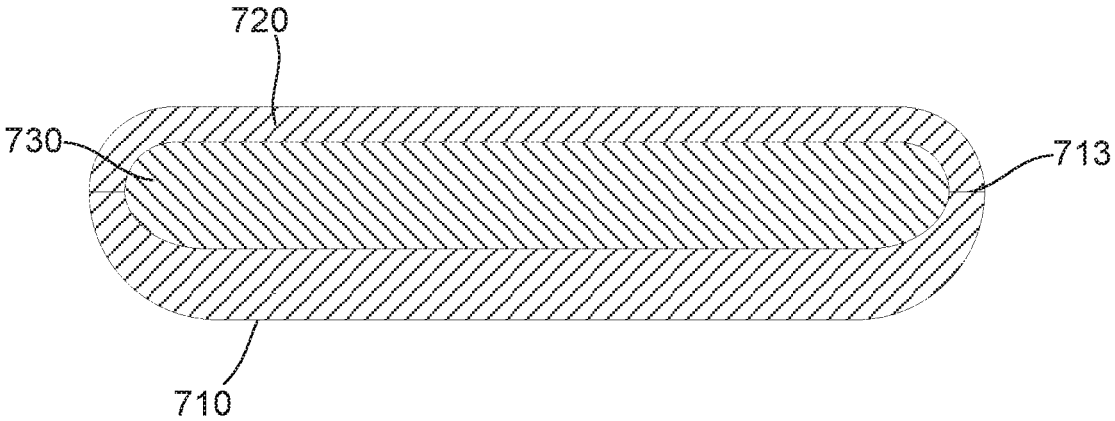
FIG. 7 is a schematic cross sectional side view of an example of a wearable impact protection system including bonded inner and outer layers.

In one example, the inner and outer layers are at least partially coupled along one or more edges, as shown for example, in FIG. 7. In this arrangement the inner layer 710 and outer layers 720 are bonded along edges 713 to form an enclosed system. This can be useful when the impact protection system forms a discrete pad, which can be incorporated into a pocket in a jacket, such as a shoulder pad or elbow pad for a motorcycle jacket or similar.

In one example, the intermediate layer is at least partially coupled to either the inner and/or outer layers. Such coupling can be over the entire surface area or can be at selected locations. In one example, the inner and outer layers are coupled to the intermediate layer at different points to facilitate flexure of the impact protection apparatus. Coupling between the layers can be achieved using a variety of techniques, depending on the particular materials used. For example, this could include mechanical bonding, such as an interference fit between surface features, chemical bonding such as adhesive, welding such as heat welding, the use of discrete fasteners, or the like. However, this is not essential, and other mechanisms for retaining the layers in place could be used, such as placing the layers in an outer cover, the use of external or internal elasticated strapping, or the like.

In a further example, the system can include a plurality of cells, each of which includes a structure similar to that of the arrangement of FIG. 7, so that each cell includes inner, outer and intermediate layers. These layers can extend across the entire cell, or may extend only across part of the cell, so that, for example, the intermediate layer is wholly embedded between the inner and outer layers, to thereby protect the intermediate layer.

In one example, the cells are configured in a tessellated arrangement, to provide coverage as though the cells are unitary layers, thereby providing the same effective impact protection as unitary layers. Nevertheless, providing a plurality of cells in this manner can provide a number of potential benefits. For example, this allows individual cells to have different shapes, so that collectively the impact protection system can more easily conform to a shape of a user.

In one particular example, the plurality of cells include at least first and second cell shapes, which can be configured to at least partially overlap, for example by having complementarily sloped side walls, thereby ensuring protection is provided over the full extent of the impact protection system. In one such example, the side walls are sloped at an angle that is greater than 5°, greater than 10°, greater than 15°, greater than 20°, less than 45°, less than 40°, less than 35°, less than 30°, or approximately 27°.

In one preferred example, the cells are mounted on a substrate layer, which could be a flexible and/or elasticated substrate, allowing the impact protection system to have a greater ability to adapt to the shape of a user, hence making this more comfortable to use. The substrate layer can be made of an elasticated fabric, a woven fabric, a non-woven fabric, or the like.

In one example, some or all of cells are removably mounted to the substrate layer. This can allow cells to be interchanged, to replace damaged cells or to change cells for cells with different properties, for example to provide increased or decreased protection. This also allows cells to be replaced with different functional elements, such as air vents or similar. The substrate layer can also be coupled to a securing mechanism to secure the impact protection system to a user.

Figure 8A:
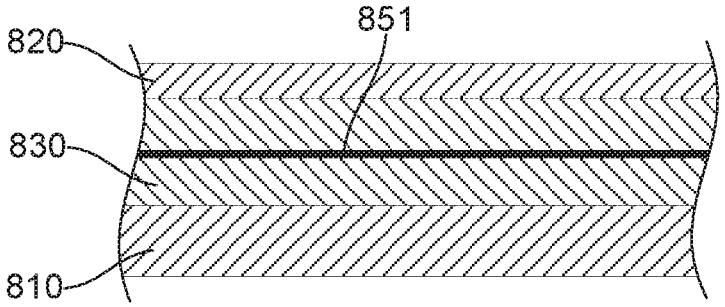
FIG. 8A is a schematic cross sectional side view of an example of a wearable impact protection system incorporating an internal frame.
Figure 8B:
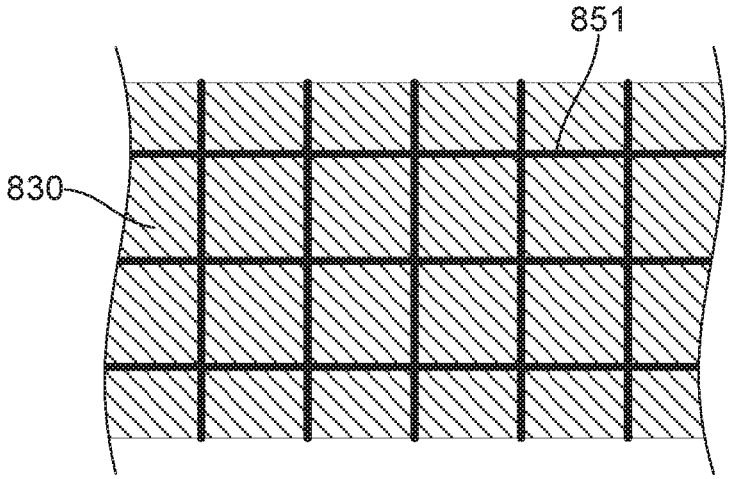
FIG. 8B is a schematic cross plan view of the frame of FIG. 8A.

In a further example shown in FIGS. 8A and 8B the impact protection system includes an internal frame, which in this example is shown as a grid 851. The internal frame can be provided within the intermediate layer 830 or could be provided between the intermediate layer 830 and either the inner or outer layers 810, 820. The frame is typically formed from a plastic such as HDPE (high density polyethylene) and can be used in order to provide additional rigidity.

It will further be appreciated that the arrangement can include additional layers, for example to enhance the ability to protect against impacts. This could include for example providing further intermediate layers, such as a mesh or woven or non-woven fabric layer. This can be made of any suitable material, and could include carbon fibre and/or Kevlar, to provide additional impact protection, and in particular to reduce the likelihood of penetration by sharp objects.

In a further example, the impact protection system includes a penetration resistant layer, made from a thermoplastic polymer, such as ABS (Acrylonitrile Butadiene Styrene), or HDPE (High-density polyethylene), or from other materials, such a Kevlar or the like.

The wearable impact protection system can also include a visual indicator indicative of a damage state of the impact protection system. This could be of any appropriate form and could include a colour change or similar, for example, using an encapsulated dye or the like, which is released following an impact of more than a certain magnitude, or using a material that responds to heat resulting from the impact. This can be used to inform the user of whether the impact protection system might be damaged, and hence whether all or some of the impact protection system might need replacement.

Figure 9A:
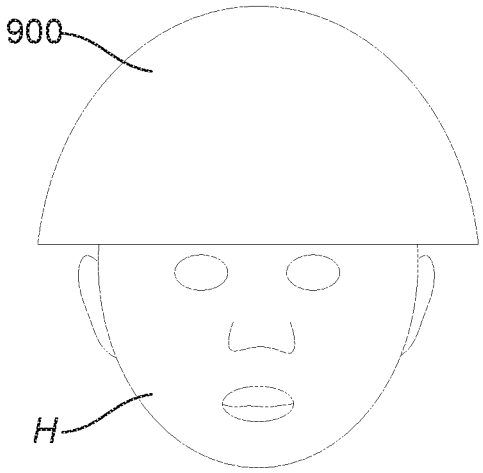
FIG. 9A is a schematic front view of an example of a helmet.
Figure 9B:
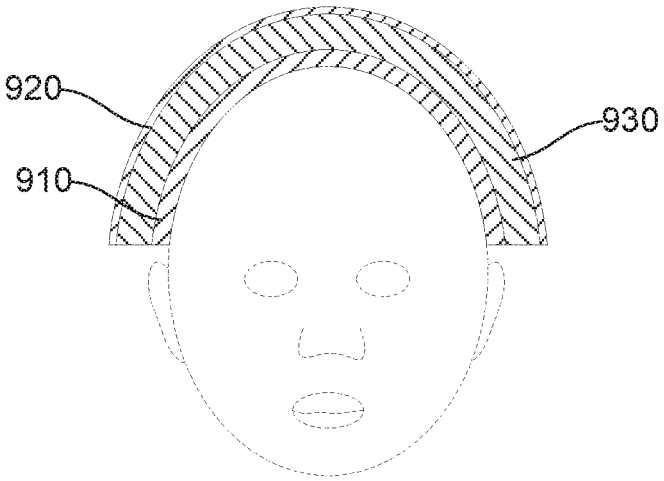
FIG. 9B is a schematic cross sectional front view of the helmet of FIG. 9A.

In one particular example, the impact protection system is in the form of a helmet adapted for use in sports such as skiing, snowboarding, cycling or the like. An example helmet arrangement will now be described with reference to FIGS. 9A and 9B.

In this example, the helmet 900 typically has a generally hemispherical arrangement adapted to be placed on a user's head H. The helmet again includes a three-layer arrangement including inner and outer layers 910, 920 and an intermediate layer 930. It will be appreciated that the helmet can incorporate features similar to those outlined above, and will not therefore be described in further detail.

In one example, the helmet is formed from inner and outer layers 910, 920 that are moulded foams shaped at least partially conformed to the head of a wearer. The foam layers typically include some inherent elasticity, allowing suitably sized layers to be retained on the wearer's head solely through the elastic nature of the helmet, although this is not essential and other mechanisms to hold the helmet in place can be used, as will be described in more detail below. It will be appreciated however that this may require that different sized helmets are made for different users and in another example the helmet can incorporate an adjustment mechanism allowing this to be used with a range of different head sizes.

In one particular example, the inner and outer layers have an approximately hemispherical shape and include one or more radial slits having overlapping edges, allowing the circumferential size of the helmet to vary depending on the magnitude of the overlap, and an example of this will now be described with reference to FIGS. 10A to 10H.

Figure 10A:
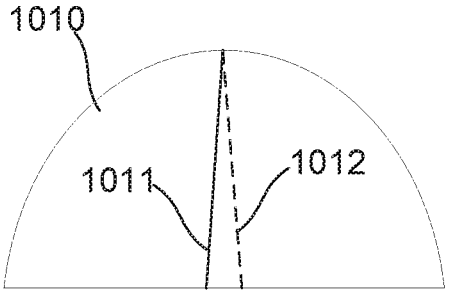
FIGS. 10A to 10C are schematic front plan and cross sectional views of an example of a helmet layer in an expanded configuration.
Figure 10D:
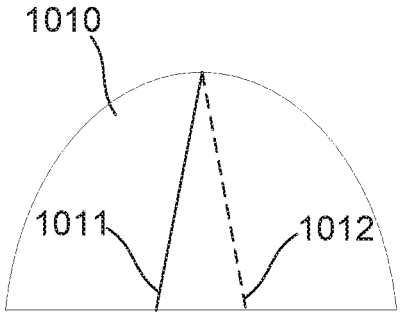
FIGS. 10D to 10F are schematic front plan and cross sectional views of the helmet layer of FIGS. 10A to 10C in a contracted configuration.
Figure 10B:
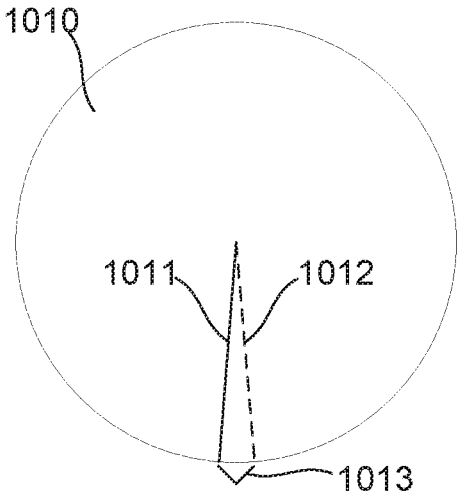
Figure 10E:
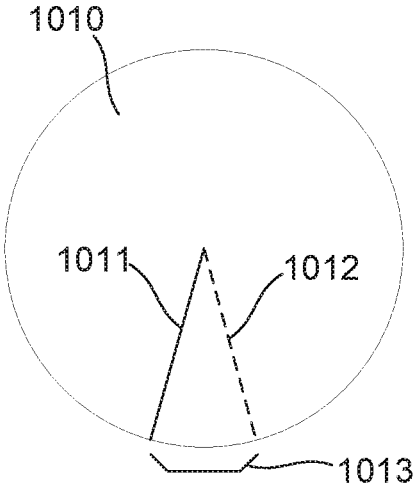
Figure 10C:
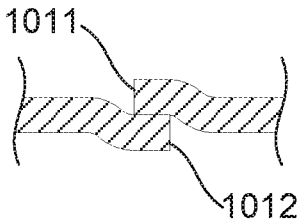
Figure 10F:
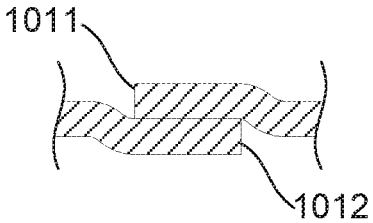

In this regard FIGS. 10A to 10C and 10D to 10F, show how a radial slit with overlapping edges 1011, 1012 can be used in order to adjust the circumference of the inner layer 1010. In this example, the radial slit defines edges 1011, 1012 which overlap at an overlapping join 1013. As the degree of overlap is increased as shown in FIGS. 10D to 10F, the circumference of the inner layer is reduced. It will be appreciated that similar mechanisms can be used for the other layers, allowing this to be used to construct a helmet having an adjustable size, but which retains impact protection at the overlapping join. This in turn allows a helmet to be manufactured that fits a range of different users.

Figure 10G:
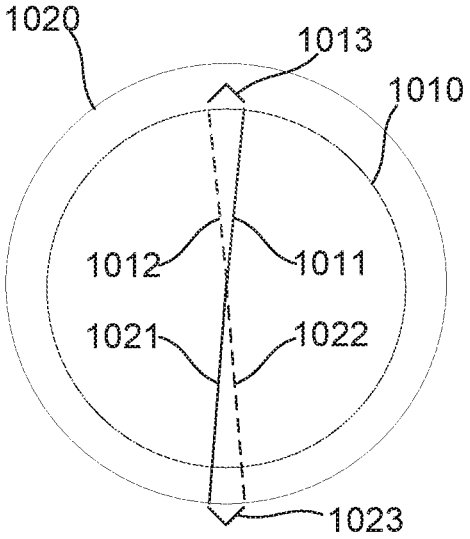
FIGS. 10G and 10H are schematic plan views of two helmet layers in expanded and contracted configurations.
Figure 10H:
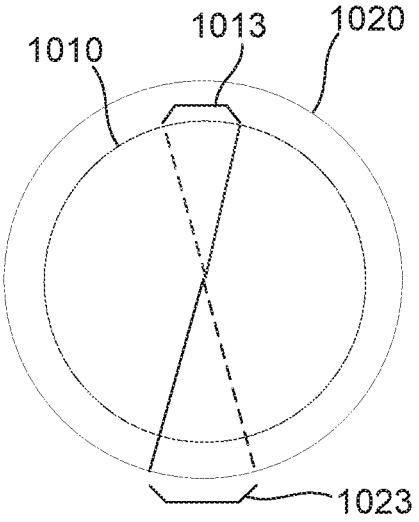

In the event that such overlapping joins are to be used, it will be appreciated that this results in a doubling of thickness of the layer in the region of the join. Accordingly, in one example the joins 1013, 1023 of the inner and outer layers 1010, 1020 are offset by 180° as shown in FIGS. 10G and 10H thereby avoiding coincident doubling of thickness.

In arrangements of this form, the intermediate layer could be selectively coupled to the inner and outer layers to allow for movement in the overlapping joins, for example so that the intermediate layer is coupled to the outer layer 1020 in the region of the inner layer overlapping join 1013, and vice versa.

It will also be appreciated that a wide range of different physical configurations could be utilised in order to achieve an overall shape similar to that of the human head. For example, the inner and outer layers could be formed of a plurality of triangular sheets with overlapping joins.

Figure 11A:
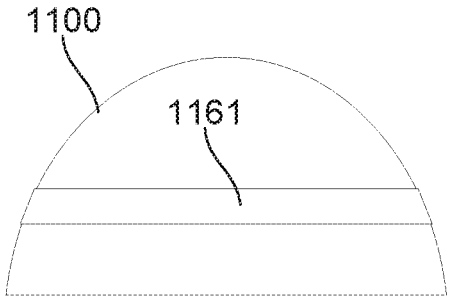
FIG. 11A is a schematic front view of a first example of an adjustment mechanism.

In one example, an adjustment mechanism is provided to adjust the size of the helmet. Any suitable adjustment mechanism could be used, such as to provide one or more tensioning members, such as straps extended circumferentially around the helmet as shown for example in FIG. 11A.

In this example a strap 1161 is provided extending around the outside of the helmet with the strap optionally being elasticated or including tensioning members such as a ratchet tensioning system in order to allow the circumference of the helmet to be reduced until a comfortable fit is achieved. It will also be appreciated however that such members could be provided internally within the helmet, for example within the intermediate layer, or between the inner or outer layers and intermediate layer.

Figure 11B:
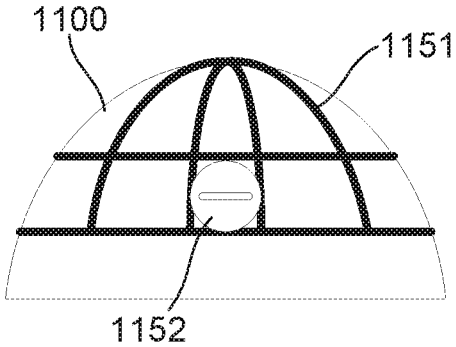
FIG. 11B is a schematic front view of a second example of an adjustment mechanism.

An alternative arrangement is shown in FIG. 11B in which a ratcheting system is attached to a plastic frame 1151 mounted within the helmet, with a dial 1152 being used to control a degree of tension within the frame, thereby adjusting the helmet until it conforms to the head of the user.

Figure 12:
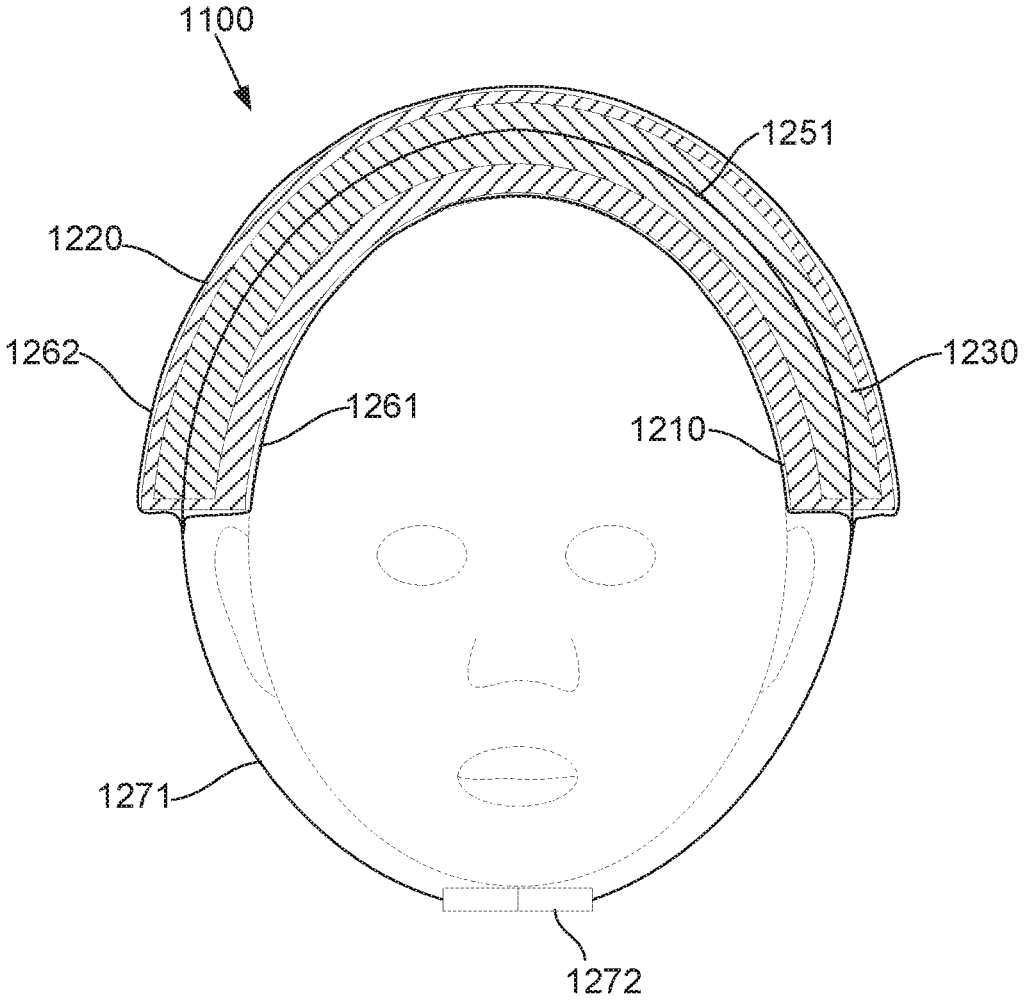
FIG. 12 is a schematic cross sectional front view of a further example of a helmet.
Figure 13A:
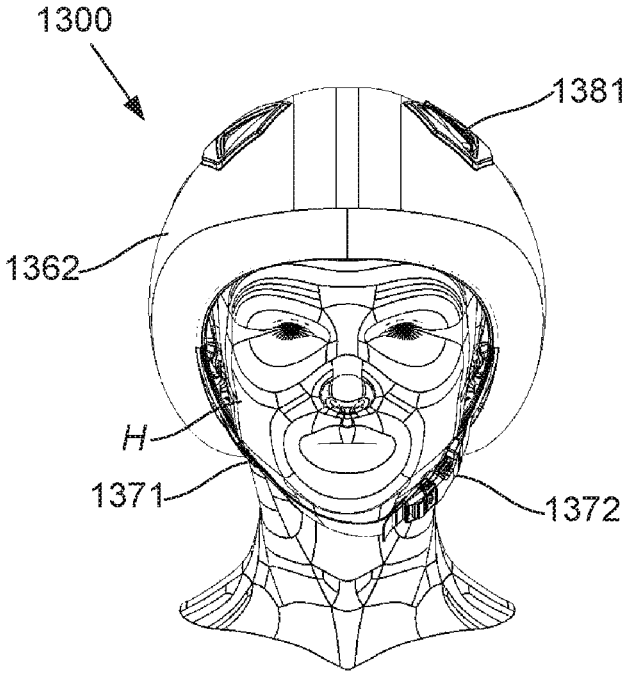
FIG. 13A is a schematic front view of a specific example of a helmet.
Figure 13B:
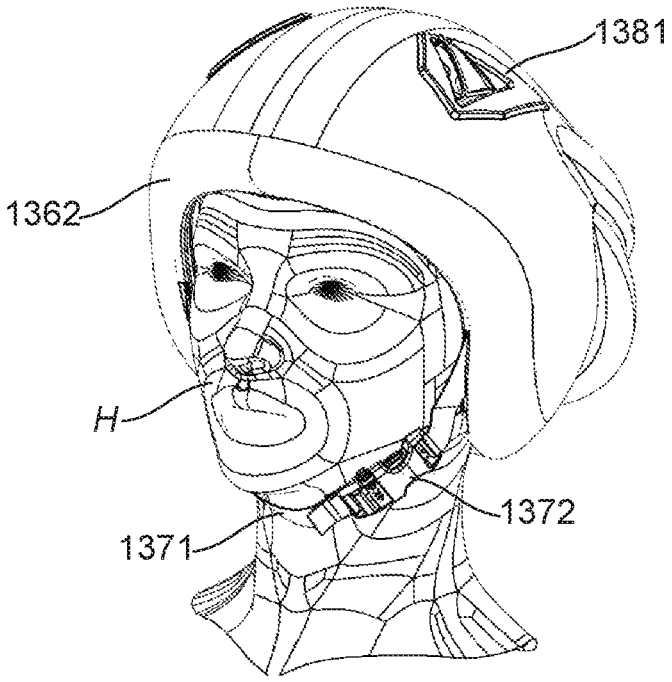
FIG. 13B is a schematic front topside perspective view of the helmet of FIG. 13A.
Figure 13C:
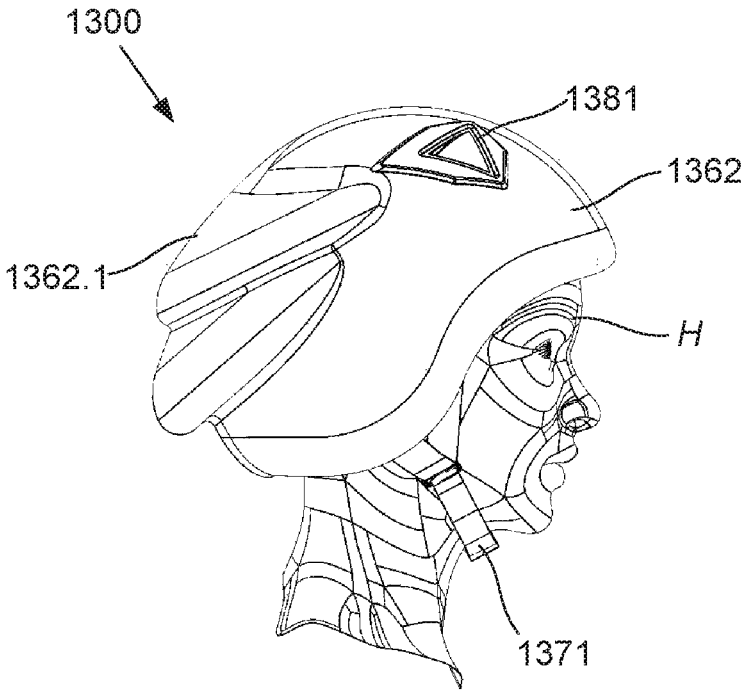
FIG. 13C is a schematic side view of the helmet of FIG. 13A.
Figure 13D:
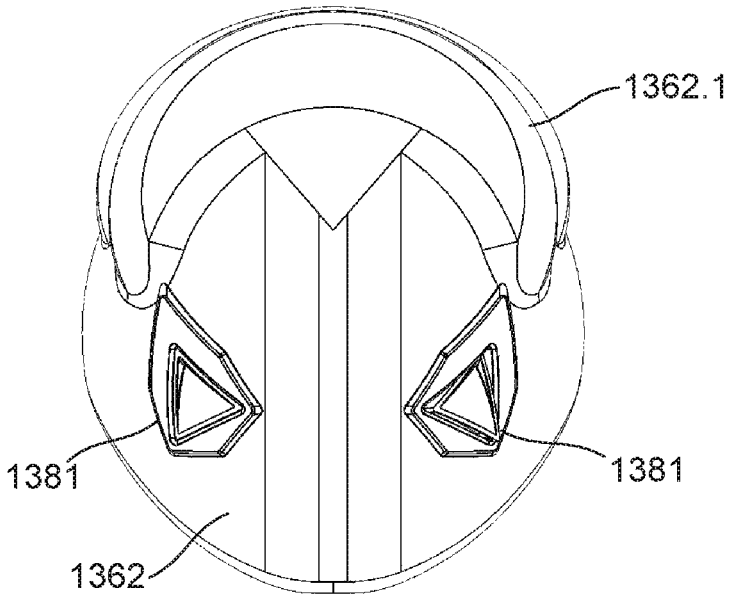
FIG. 13D is a schematic plan view of the helmet of FIG. 13A.
Figure 14A:
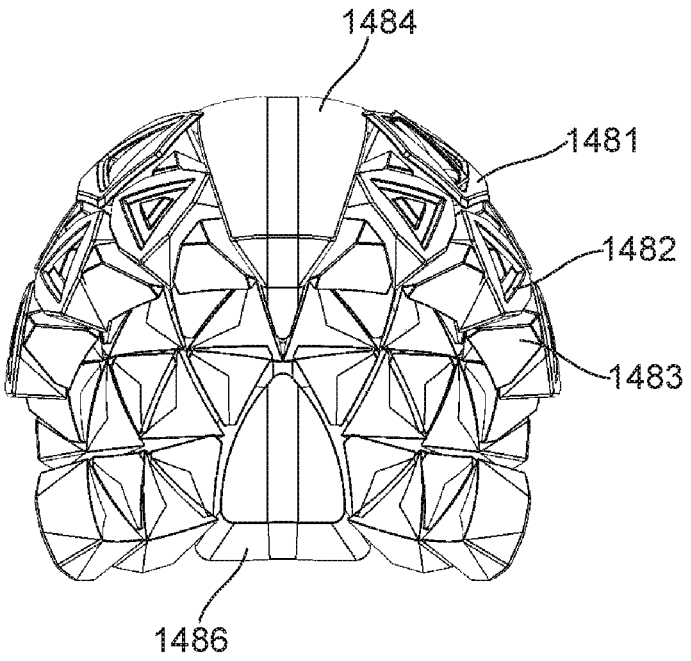
FIG. 14A is a schematic front view of an example of the internal structure of the helmet of FIG. 13A.
Figure 14B:
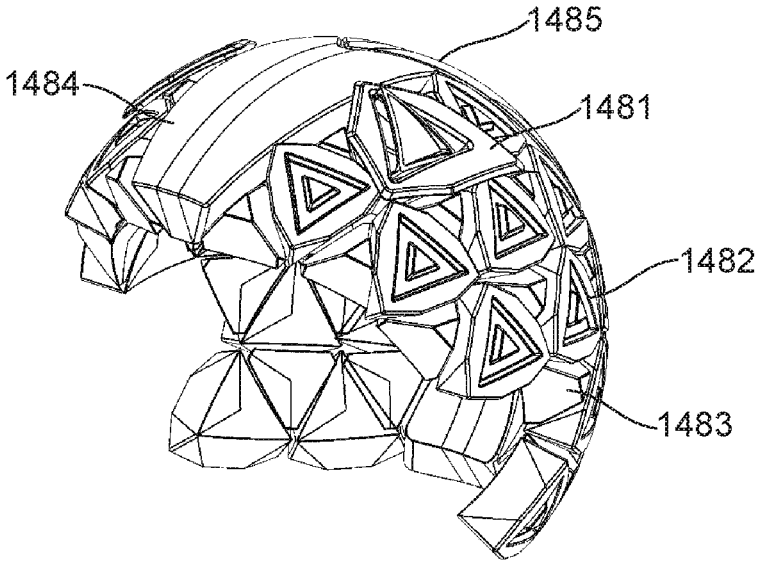
FIG. 14B is a schematic front topside perspective view of the internal structure of FIG. 14A.
Figure 14C:
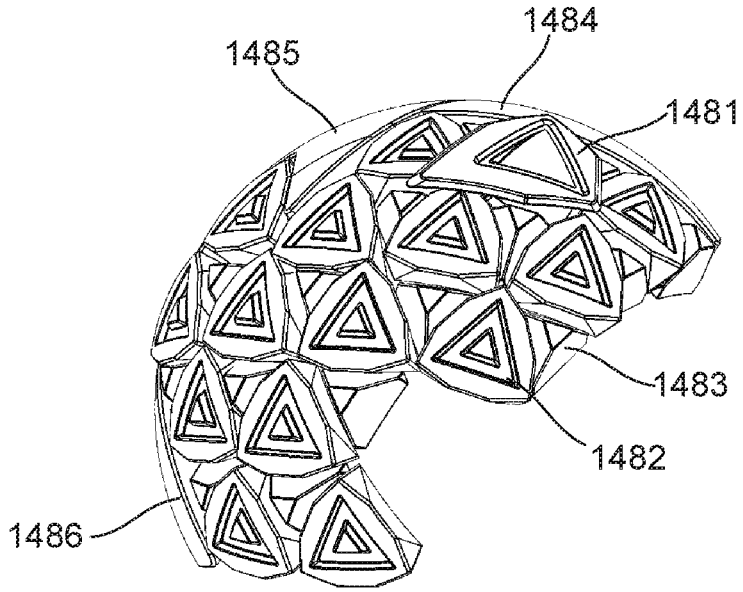
FIG. 14C is a schematic side view of the internal structure of FIG. 14A.
Figure 14D:
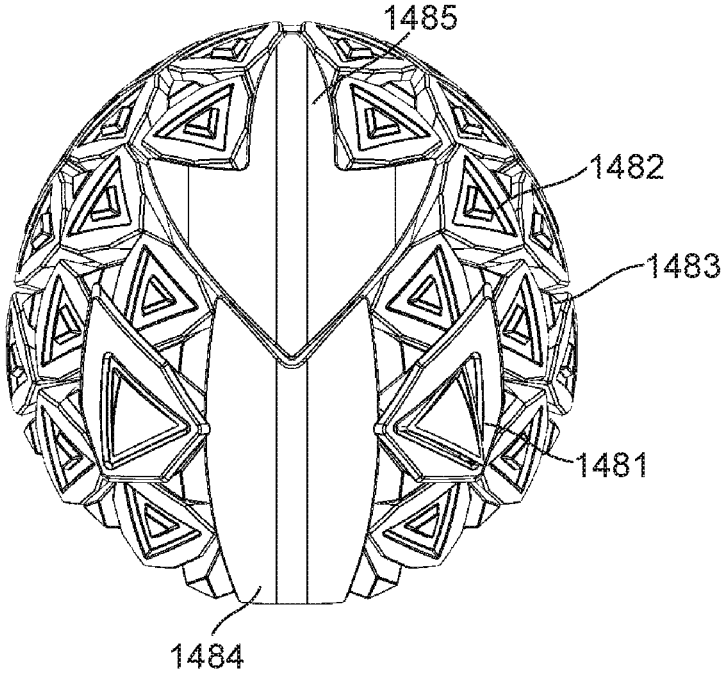
FIG. 14D is a schematic plan view of the internal structure of FIG. 14A.
Figure 14E:
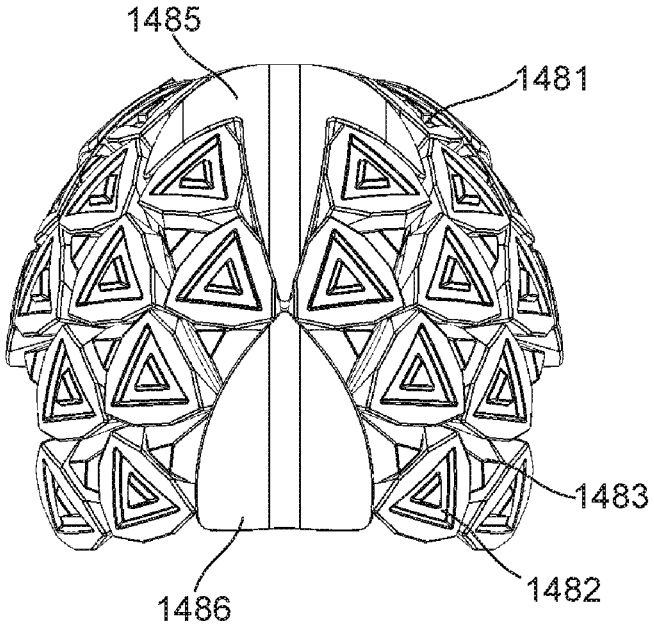
FIG. 14E is a schematic rear view of the internal structure of FIG. 14A.

An example of a complete helmet is shown in more detail in FIG. 12. In this example, the helmet includes chin straps 1271, interconnected via a buckle 1272, allowing the helmet to be secured to the head of the user. The helmet includes inner and outer skins 1261, 1262, which in one example are in the form of a woven or non-woven fabric and optionally an elasticated fabric. In one example, the inner and outer skin are fabrics having a form similar to that of a "beanie", providing a comfortable helmet arrangement, whilst ensuring suitable head protection. The chin straps can be coupled to the inner and outer skin and may also optionally be coupled to an internal frame 1251 for strength.

A further specific example of a helmet will now be described with reference to FIGS. 13A to 13D.

In this example, the helmet includes chin straps 1371, interconnected via a buckle 1372, allowing the helmet to be secured to the head of the user.

The helmet includes an outer skin 1362, which extends over outer and inner surfaces of the helmet. The outer skin 1362 is typically in the form of a woven or non-woven fabric, and optionally elasticated fabric, and more preferably is a fabric having a form similar to that of a "beanie", and could include natural fibres such as Merino wool or synthetic fibres or knits. This allows the outer skin to act as a breathable lining, in which case Merino wool is particularly advantageous due to its soft, moisture wicking, antibacterial and low odour properties.

In this example, the outer skin also includes folded sections 1362.1, which can be opened, for example using a zip or similar, allowing access to the internal structure of the helmet. This allows the external layer skins to be replaceable, for example to allow the outer layer's design and colour be trend based, and changed seasonally.

The inner and outer layer typically include apertures to allow the chin straps to extend therethrough. In use, the chin straps are attached to an inner skin, which is made of a flexible and breathable sports mesh, with a non-elasticated nylon webbing stitched into a hem to allow the chin straps to be attached thereto. The inner skin acts as a structural support for the internal structure of the helmet, described below.

Additionally, in this example, air vents 1381 are provided, which allow air flow through the helmet internal structure, to thereby prevent overheating of the user.

An example of the internal structure is shown in FIGS. 14A to 14E.

In this example, the internal structure includes a number of cells 1482, 1483, 1484, 1485, 1486, which are attached to the inner skin and arranged in a tessellating formation, in order to provide impact protection over the entire helmet structure. Each of the cells includes a triple layer internal structure, including inner and outer layers of non-Newtonian rubber, and an intermediate impact layer.

In this example, five different shapes of cell are provided, including first and second cells 1482, 1483, which are provided in a tessellating arrangement over the outer curved hemispherical portions of the helmet, and ridge cells 1484, 1485, 1486, which extend along a central portion of the helmet, which in use aligns with a centre of the user's head. In this regard, in general, most individuals have a relatively consistent outer head curvature, with differences between the majority of individuals arising in the shape and width of the centre of the head. Accordingly, the above described arrangement allows different shapes of ridge cells to be used to accommodate different head sizes and shapes, whilst the first and second cells can remain consistent across different helmet sizes.

In the current example, it will be appreciated that the air vents 1481 also integrate into the tessellating first and second cells, in this example replacing respective ones of the first cells 1482, although this is not essential, and in some applications air vents might not be required.

In practice, the cells are typically attached to the inner and/or outer skin of the helmet. This attachment could be permanent, for example by bonding the cells to the inner and/or outer skin, using mechanical bonding, chemical bonding, or similar. In another example, the cells can be removably attached to the skin(s), for example, using a releasable hook and loop fastener, such as Velcro™ or Dual Lock™ Reclosable Fasteners, or using a press stud, other similar mechanical arrangement. This allows cells to be removed and/or interchanged, for example to allow damaged cells to be removed and replaced, or to allow air vents 1481 to be interchanged with first cells 1482.

Figure 15A:
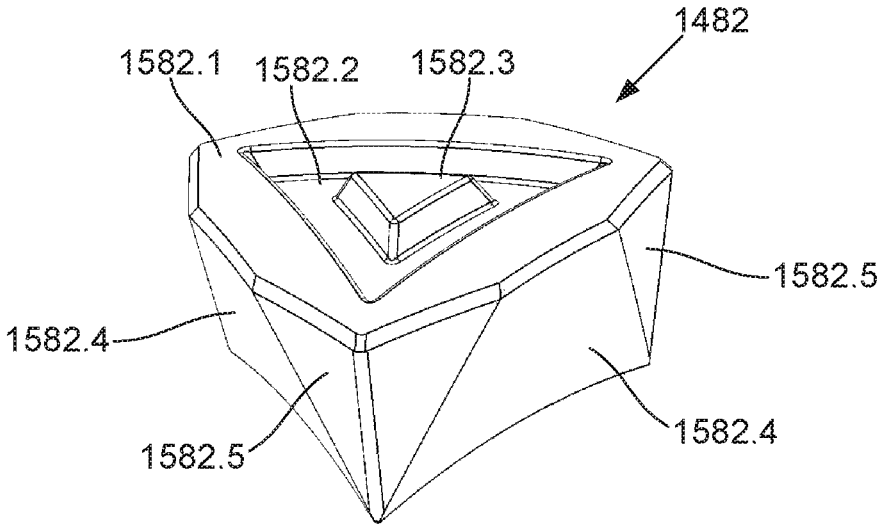
FIG. 15A is a schematic front topside perspective view of a first cell of the internal structure of FIG. 14A.
Figure 15B:
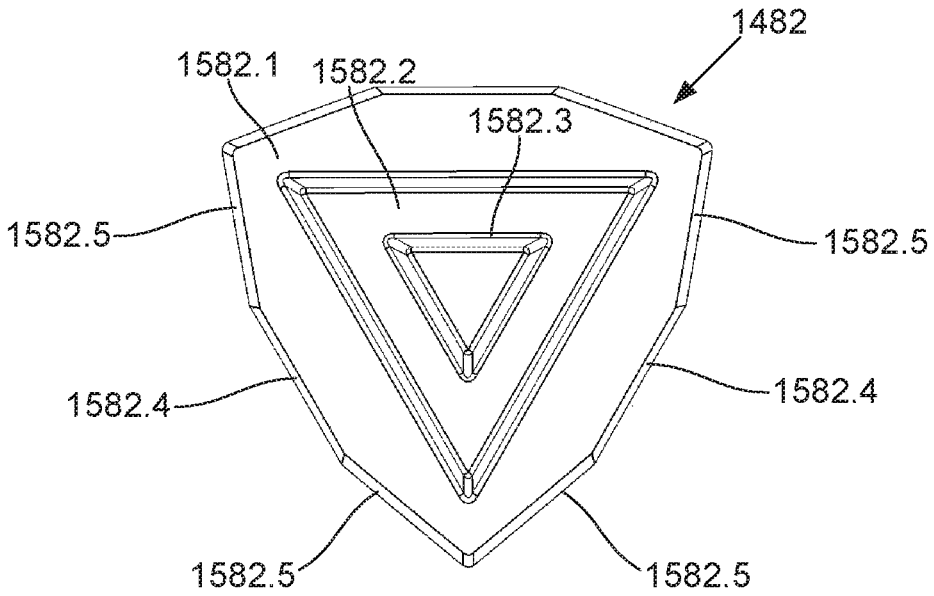
FIG. 15B is a schematic plan view of the first cell of FIG. 15A.
Figure 15C:
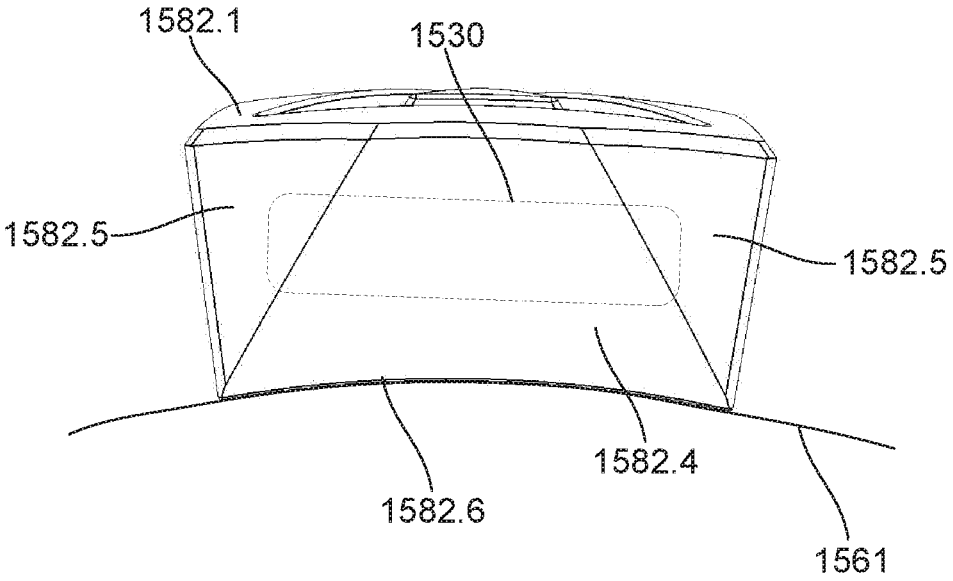
FIG. 15C is a schematic side view of the first cell of FIG. 15A.
Figure 16A:
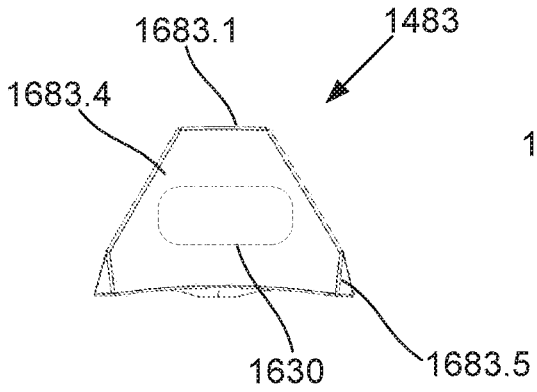
FIG. 16A is a schematic front view of a second cell of the internal structure of FIG. 14A.
Figure 16B:
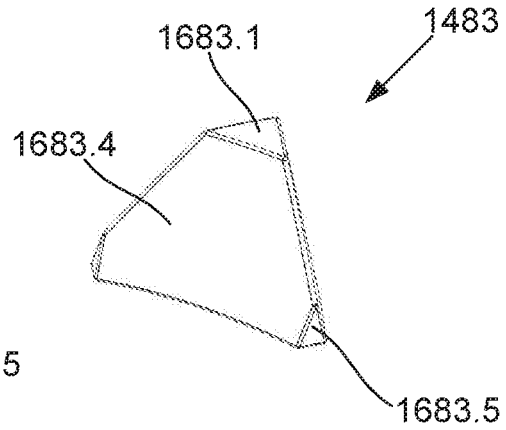
FIG. 16B is a schematic front topside perspective view of the second cell of FIG. 16A.
Figure 16C:
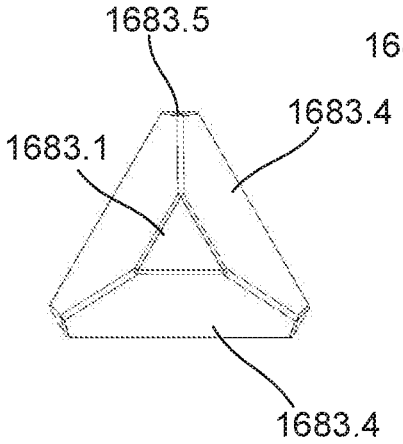
FIG. 16C is a schematic plan view of the second cell of FIG. 16A.
Figure 16D:
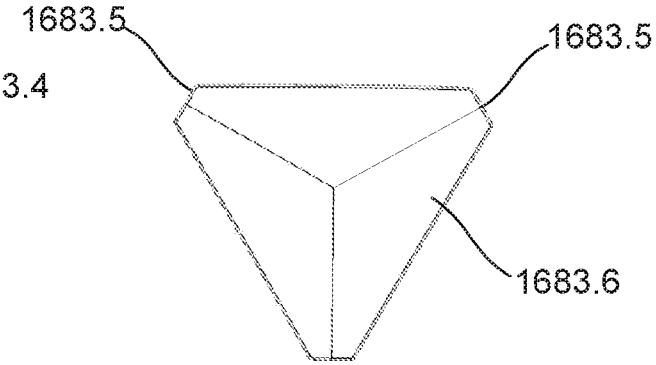
FIG. 16D is a schematic underside view of the second cell of FIG. 16A.
Figure 17A:
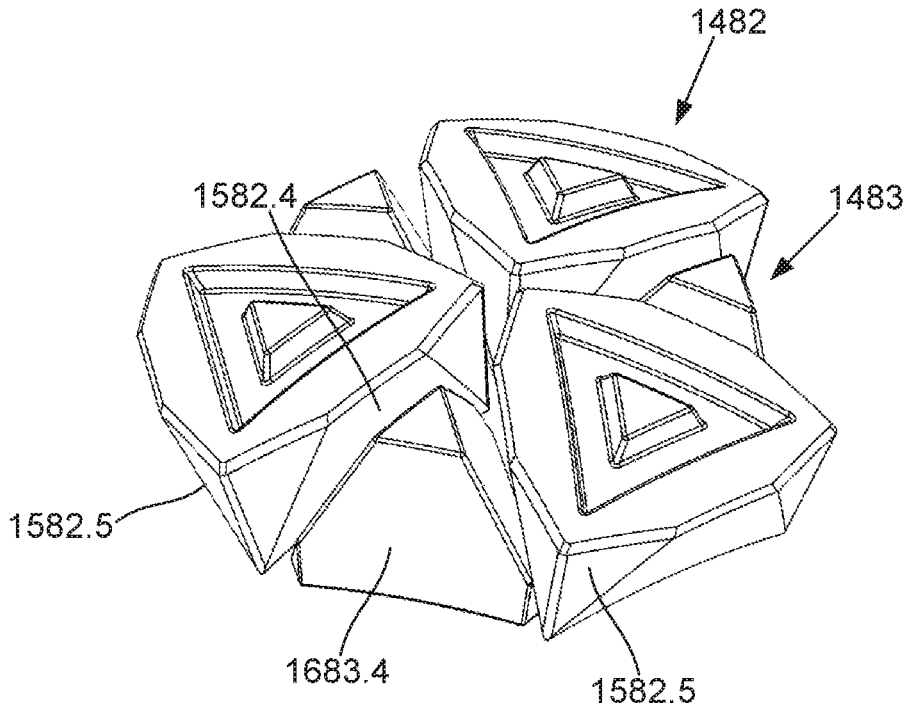
FIG. 17A is a schematic front topside perspective view of tessellating first and second cells of FIGS. 15A and 16A.
Figure 17B:
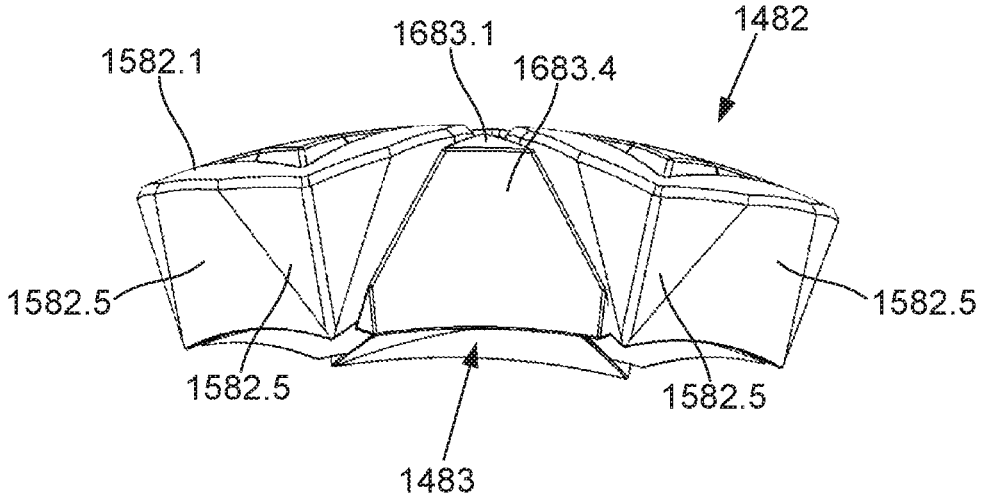
FIG. 17B is a schematic front view of the tessellating first and second cells of FIG. 17A.
Figure 17C:
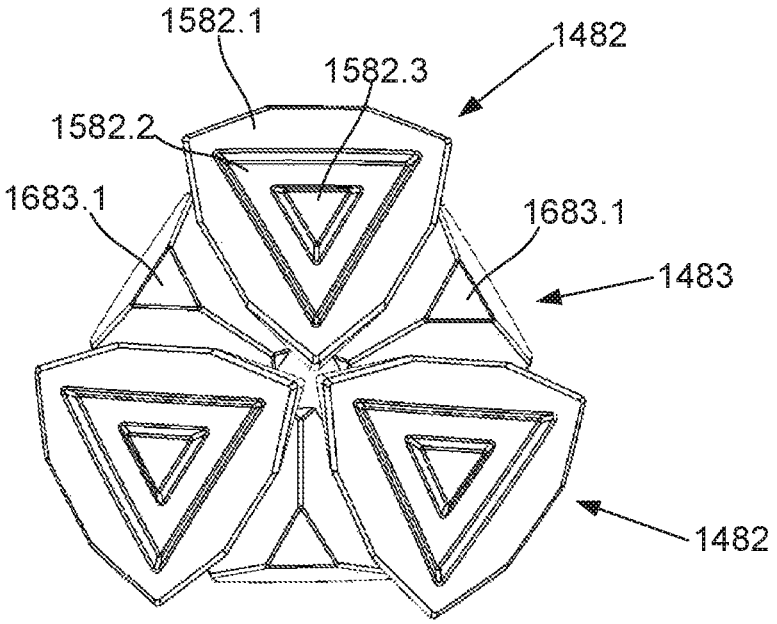
FIG. 17C is a schematic plan view of the tessellating first and second cells of FIG. 17A.
Figure 17D:
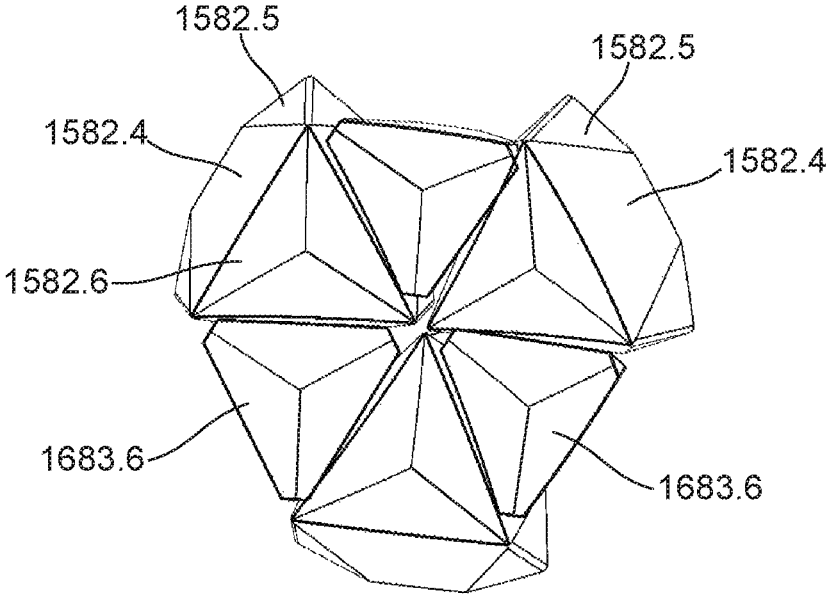
FIG. 17D is a schematic underside view of the tessellating first and second cells of FIG. 17A.
Figure 18A:
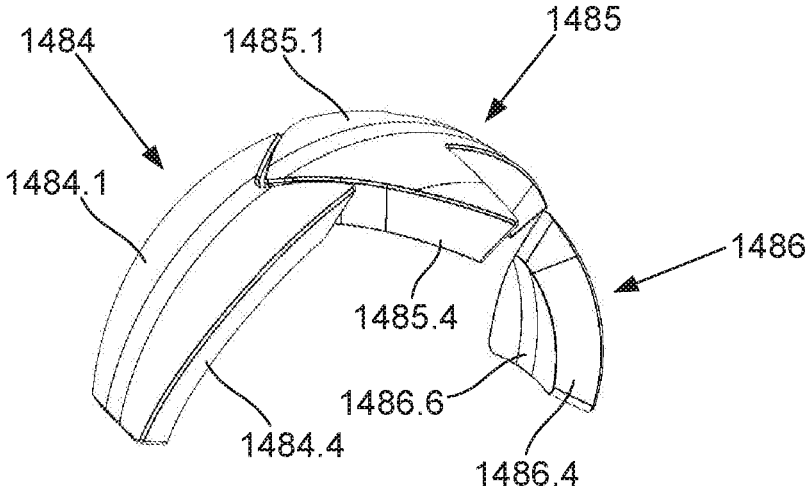
FIG. 18A is a schematic front topside perspective view of ridge cells of the internal structure of FIG. 14A.
Figure 18B:
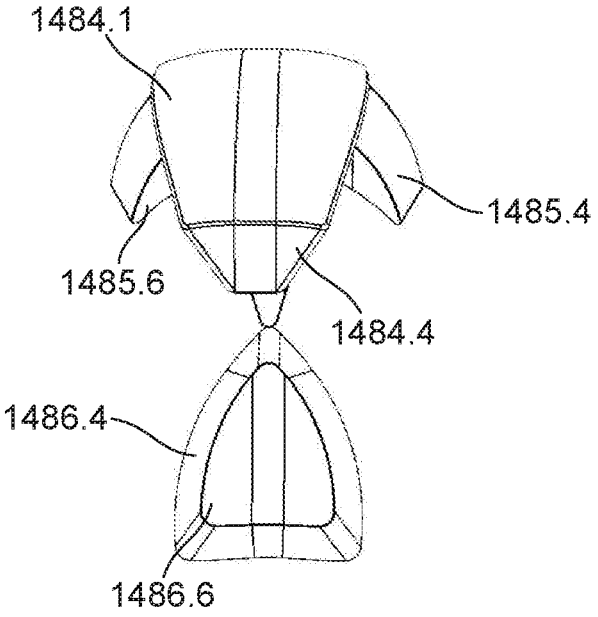
FIG. 18B is a schematic front view of the ridge cells of FIG. 18A.
Figure 18C:
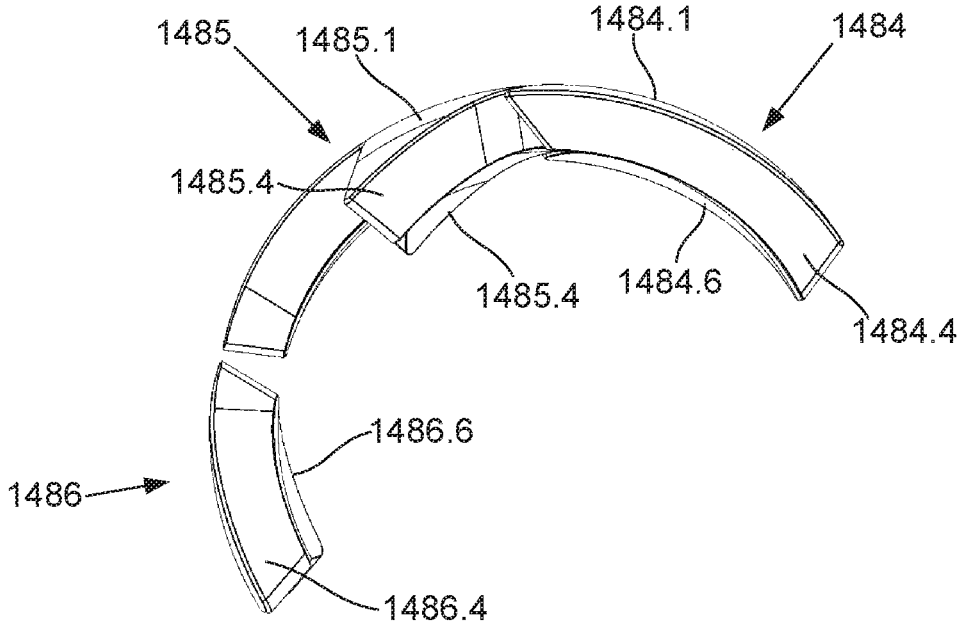
FIG. 18C is a schematic side view of the ridge cells of FIG. 18A.
Figure 18D:
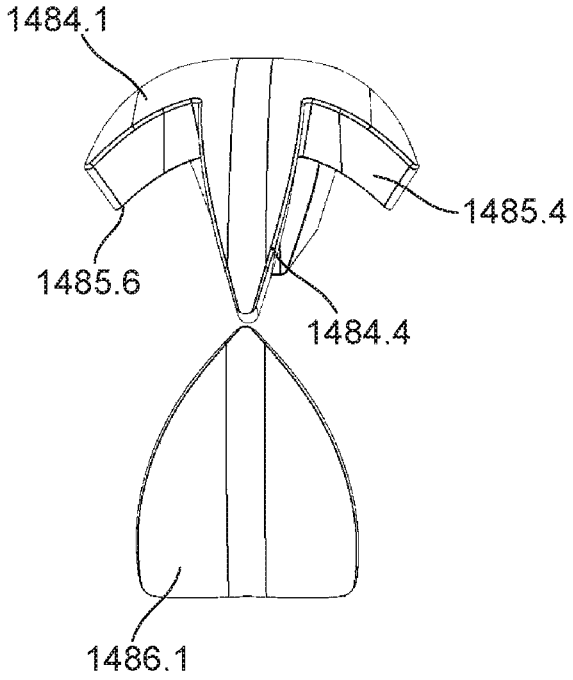
FIG. 18D is a schematic rear view of the ridge cells of FIG. 18A.

An example of the first cell configuration is shown in FIGS. 15A to 15C.

In this example, the first cell 1482 includes an upper surface 1582.1, having nine sides, provided in a generally triangular configuration. A channel 1582.2 surrounds a central triangular raised section 1582.3, which can help provide flexibility and reduce overall weight, whilst maintaining structural strength and overall impact protection. This can also be used to act as a damage indicator, for example by having the raised section 1582.3 undergo deformation and/or a colour change in response to an impact greater than a fixed defined level.

The first cell 1482 further includes side walls 1582.4 and corner walls 1582.5, which extend downwardly and inwardly from a perimeter of the upper surface 1582.1. In this example, the side walls 1582.4 slope inwardly at a greater angle than the corner walls 1582.5, typically about 27°, whilst the corner walls 1582.5 are triangular in shape, resulting in a triangular base 1582.6, having a smaller perimeter than the upper surface 1582.1. The base 1582.6 also has a slight concave profile, which facilitates attachment to the inner skin 1561, whilst generally conforming to a curvature of the user's head.

The first cells 1482 are generally made of non-Newtonian rubber and include an internal impact absorbing foam layer 1530, which can be wholly contained within the first cell, as shown by the dotted lines in FIG. 15C, or could extend entirely across the cell.

An example of the second cell configuration is shown in FIGS. 16A to 16D.

In this example, the second cell 1483 includes an upper triangular surface 1683.1 and includes side walls 1683.4, which extend downwardly and outwardly from a perimeter of the upper surface 1683.1 to a triangular base 1683.6, which therefore has a larger footprint than the upper surface 1683.1. Corner cut-outs 1683.5 are provided to avoid sharp corners at apexes where the side walls and base 1683.4, 1683.6 meet. Again the second cells 1483 are made of a non-Newtonian rubber and include an internal impact absorbing foam layer 1630, which can be wholly contained within the first cell, as shown by the dotted lines in FIG. 16A, or could extend entirely across the cell.

The resulting tessellated arrangement is shown in FIGS. 17A to 17D.

As shown, the first and second cells 1482, 1483 are positioned so that each second cell 1483 is surrounded by three first cells 1482, with the first cell side walls 1582.4 abutting against the second cell side walls 1683.4. The second cells 1483 are smaller than the first cells 1482, so that the first cell corner walls 1582.5 are provided in opposition. In practice, the second cell side walls 1683.4 slope at less of an angle than the first cell side walls 1582.4, so that the tessellated cell structure has an overall concave underside and convex upper side, thereby conforming to the curvature of the user's head. Additionally, the sloping side walls result in overlap between the first and second cells 1482, 1483, preventing penetration or objects between the cells, thereby maintaining impact protection integrity, whilst allowing for some relative movement of the cells, which in turn helps the overall structure conform to a shape of the user's head.

Finally the structure of ridge cells are as shown in FIGS. 18A to 18D.

In this example, the ridge cells include front, mid and rear cells 1484, 1485, 1486, each having upper surfaces 1484.1, 1485.1, 1486.1, and side walls 1484.4, 1485.4, 1486.4 sloping downwardly and inwardly to respective concave lower surfaces 1484.6, 1485.6, 1486.6. The ridge cells include outer perimeters shaped to interlock with the tessellated first and second cells, and it will be appreciated that the particular shape used will vary depending upon the preferred implementation.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers. As used herein and unless otherwise stated, the term "approximately" means±20%.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

It will of course be realised that whilst the above has been given by way of an illustrative example of this invention, all such and other modifications and variations hereto, as would be apparent to persons skilled in the art, are deemed to fall within the broad scope and ambit of this invention as is herein set forth.

The invention claimed is:

1. A wearable impact protection system including:

a) an inner layer of a first shear thickening material that faces a wearer in use;

b) an outer layer comprising separate sheets formed of a second shear thickening material;

c) an intermediate deformable layer;

d) a join defined where the separate sheets of the outer layer overlap, the join having a portion that protrudes into the intermediate layer; and a rib on an inner surface of the outer layer that projects downward into a recess on an upper surface of the intermediate layer.

2. The wearable impact protection system according to claim 1, further comprising teeth on the inner surface of the outer layer that engage with the intermediate layer to prevent relative movement between the inner and outer layers.

3. The wearable impact protection system according to claim 1, wherein:

a) the inner layer has a thickness that is at least one of:
i) 1 mm;
ii) >3 mm;
iii) <10 mm;
iv) <12 mm;
v) 3-10 mm;
vi) 4-8 mm;
vii) 5-7 mm;
viii) 5 mm; and,
ix) 6 mm;

b) the outer layer has a thickness that is at least one of:
i) 1 mm;
ii) >1 mm;
iii) <8 mm;
iv) <10 mm;
v) <12 mm;
vi) 1-5 mm;
vii) 2-4 mm;
viii) 5 mm; and,
ix) 3 mm;

c) the intermediate layer has a thickness that is at least one of:
i) >5 mm;
ii) <20 mm;
iii) 5-20 mm;
iv) 8-17 mm;
v) 10-15 mm;
vi) 8-12 mm; and,
vii) 10 mm.

4. The wearable impact protection system according claim 1, wherein at least one of:

a) the inner layer has a density that is at least one of:
i) >80 kg/m$^3$;
ii) <400 kg/m$^3$;
iii) <200 kg/m$^3$;
iv) 100-400 kg/m$^3$;
v) 100-200 kg/m$^3$;
vi) 120-180 kg/m$^3$;
vii) 140-160 kg/m$^3$;
viii) >500 kg/m$^3$;
ix) >1000 kg/m$^3$;
x) <1400 kg/m$^3$;
xi) <1200 kg/m$^3$; and,
xii) 1100-1140 kg/m$^3$;

b) the outer layer has a density that is at least one of:
i) >80 kg/m$^3$;
ii) <400 kg/m$^3$;
iii) 150-400 kg/m$^3$;
iv) 180-340 kg/m$^3$;
v) 200-300 kg/m$^3$;
vi) >500 kg/m$^3$;
vii) >1000 kg/m$^3$;
viii) <1400 kg/m$^3$;
ix) <1200 kg/m$^3$; and,
x) 1100-1140 kg/m$^3$, c) the intermediate layer has a density that is at least one of:
i) >100 kg/m$^3$;
ii) >200 kg/m$^3$;
iii) <1000 kg/m$^3$;
iv) <800 kg/m$^3$; and,
v) 300-500 kg/m$^3$.

5. The wearable impact protection system according to claim 1, wherein:

a) at least one of the inner and outer layers are made of at least one of:
i) a shear thickening foam;
ii) a shear thickening moulded foam;
iii) a polymer matrix including a shear thickening additive; and,
iv) a polyurethane energy-absorbing material containing Polyborodimethylsiloxane;

b) the intermediate layer is made of at least one of:
i) an auxetic material;
ii) a deformable fluid layer;
iii) an impact absorbing foam;
iv) an elastically deformable layer;
v) a plastically deformable layer;
vi) a plastic;
vii) a rubber;
viii) a shear thickening material;
ix) a heat-resistant para-aramid synthetic fiber;
x) an EPU (Expanded PolyUrethane) foam;
xi) an EPS (Expanded Polystyrene) foam; and,
xii) a PPS (Polyphenylene Sulfide) foam.

6. The wearable impact protection system according to claim 1, wherein at least one of the inner, outer and intermediate layers includes at least one of:
a) a honeycomb structure;
b) one or more holes that allow airflow therethrough;
c) surface features that enhance localised flexibility;
d) surface features that at least partially engage with the intermediate layer;
e) variable thickness; and,
f) ribbing.

7. The wearable impact protection system according to claim 1, wherein the intermediate layer is coupled to both the inner and outer layers to allow constrained relative movement of the inner and outer layers.

8. The wearable impact protection system according to claim 1, wherein the system includes an internal frame that provides rigidity, the internal frame:

a) being at least one of:
i) within the intermediate layer; and,
ii) between the intermediate layer and at least one of the inner and outer layers;

b) being made of at least one of:
i) metal;
ii) plastic; and,
iii) HDPE (High-density polyethylene).

9. The wearable impact protection system according to claim 1, wherein the impact protection system includes a penetration resistant layer that is made of at least one of:
a) a thermoplastic polymer;
b) ABS (Acrylonitrile Butadiene Styrene);
c) a heat-resistant para-aramid synthetic fiber; and,
d) HDPE (High-density polyethylene).

10. The wearable impact protection system according to claim 1, wherein the impact protection system includes a visual indicator indicative of a damage state of the impact protection system that comprises encapsulated dye that is released following an impact above a certain magnitude.

11. The wearable impact protection system according to claim 1, wherein the impact protection system is a helmet and at least one of the following:

a) at least one of the inner and outer layers are moulded foams shaped and configured to at least partially conform to the head of a wearer;

b) at least one of the inner and outer layers has an approximately hemispherical shape with one or more radial slits having overlapping edges; or, c) the inner and outer layers each include one or more radial slits with overlapping edges, and wherein slits in the inner and outer layers are offset.

12. The wearable impact protection system according to claim 11, wherein at least one of the inner and outer layers is made of a plurality of triangular sheets with overlapping edges.

13. The wearable impact protection system according to claim 11, wherein the helmet includes an adjustment mechanism to at least partially adjust the size of the helmet by adjusting a degree of overlap between the overlapping edges, the adjustment mechanism including at least one of:

a) one or more tensioning members;

b) an elasticated tensioning system;

c) a ratchet tensioning system; and, d) an adjustable internal frame.

14. The wearable impact protection system according claim 13, wherein the one or more tensioning members are at least one of:

a) within the intermediate layer; and, b) between the intermediate layer and at least one of the inner and outer layers.

15. The wearable impact protection system according to claim 11, wherein the helmet includes one or more chinstraps to secure the helmet to a wearer, wherein the chinstraps are attached to at least one of:

a) the inner layer;

b) the outer layer;

c) an internal frame;

d) an adjustment mechanism; and, e) one or more tensioning members.

16. The wearable impact protection system according to claim 11, wherein the helmet includes an inner and outer skin, the inner, outer and intermediate layers being provided between the inner and outer skin, and wherein at least one of the inner and outer skin are made of at least one of:

a) a woven fabric;

b) a non-woven fabric; and, c) an elasticated fabric.

17. A wearable impact protection system including:

a) an inner layer of a first shear thickening material that faces a wearer in use;

b) an outer layer comprising separate sheets formed of a second shear thickening material;

c) an intermediate deformable layer;

d) a join defined where the sheets of the outer layer overlaps, the join having a portion that protrudes into the intermediate layer;

wherein the impact protection system further includes:

a plurality of cells provided in a tessellated arrangement, the plurality of cells including at least first and second cell shapes, adjacent cells being shaped to at least partially overlap;

wherein the plurality of cells are mounted on a substrate layer and comprise first and second cells, wherein the first cells each include an internal impact absorbing foam layer wholly contained within, wherein the second cells include an upper triangular surface and side walls extending downwardly and outwardly from a perimeter of an upper surface to a triangular base having a larger footprint than the upper surface, the second cells having corner cut-out, the first and second cells being positioned so that each second cell is surrounded by three first cells with the first cell side walls abutting against the second cell side walls, the second cells being smaller than the first cells so that corner walls of the first cells are provided in opposition; and wherein side walls of the second cell have a slope at less of an angle than side walls of the first cells so that the tessellated arrangement has an overall concave underside and a convex upper side conforming to a head of a user.

* * * * *